US008297573B1

(12) United States Patent
Emmert

(10) Patent No.: US 8,297,573 B1
(45) Date of Patent: Oct. 30, 2012

(54) WORK BENCH SUPPORT AND ATTACHMENT ASSEMBLY

(75) Inventor: Raymond L. Emmert, Humacao, PR (US)

(73) Assignee: Emmert Second Limited Partnership, Humacao, PR (US)

( * ) Notice: Subject to any disclaimer, the term of this patent is extended or adjusted under 35 U.S.C. 154(b) by 435 days.

(21) Appl. No.: 12/537,000

(22) Filed: Aug. 6, 2009

(51) Int. Cl.
*A47B 96/06* (2006.01)

(52) U.S. Cl. ..... 248/220.41; 248/222.14; 248/222.51; 248/539

(58) Field of Classification Search ..... 248/220.1, 248/222.11, 222.12, 222.51, 222.52, 224.8, 248/222.41, 223.21, 220.31, 220.41–220.42, 248/511, 512, 523, 527, 536, 539, 541
See application file for complete search history.

(56) References Cited

U.S. PATENT DOCUMENTS 3,785,501 A * 1/1974 Canning ..... 211/7
3,827,569 A * 8/1974 Canning ..... 211/7
4,191,111 A 3/1980 Emmert
4,387,872 A * 6/1983 Hogue ..... 248/221.11
4,405,272 A * 9/1983 Wollar ..... 411/41
4,828,209 A * 5/1989 Niemi ..... 248/220.42
5,086,935 A * 2/1992 Gallagher ..... 211/103
6,173,660 B1 1/2001 Emmert
6,283,462 B1 9/2001 Emmert

* cited by examiner

*Primary Examiner* — Gwendolyn W Baxter
(74) *Attorney, Agent, or Firm* — Hall Estill Attorneys at Law

(57) ABSTRACT

A support and attachment assembly configured for attachment to a substrate structure. The assembly includes a rigid body comprising a front surface, a back surface, and a bottom surface. A hinge flange extends from the front surface, a boss member extends from the bottom surface, and a latching member is coupled to the body. The support and attachment assembly is attached to the substrate structure by insertion of the hinge flange into a hinge aperture in the substrate structure. The body is rotated while the hinge flange remains in the hinge aperture to insert the boss member into a boss aperture through the substrate structure and to bring the bottom surface into facing relation with a top surface of the substrate structure. The latching member then contactingly engages the substrate structure to lockingly secure the assembly to the substrate structure.

17 Claims, 7 Drawing Sheets

WORK BENCH SUPPORT AND ATTACHMENT ASSEMBLY

BACKGROUND

A work bench is a type of substrate structure that can be used to provide mechanical support for personnel, tools and/or supplies during a construction operation. A variety of work bench configurations are known in the art.

U.S. Pat. No. 4,191,111 to Emmert, assigned to the assignee of the present invention, generally discloses a portable work bench with folding telescopic legs. The legs are adapted to support an elongated, substantially horizontal work bench surface at a desired elevation above an underlying floor surface. The work bench surface can serve as a scaffold, allowing a user to stand on the work bench when carrying out an overhead operation. The work bench can alternatively serve as a table-type work surface to facilitate the use of power tools or hand tools on a workpiece.

Specially configured attachments can be mated to a work bench surface to enhance the utility of a work bench. U.S. Pat. No. 6,173,660 to Emmert and assigned to the assignee of the present application, discloses a mounting panel that can be attached to a medial portion of a work bench surface to securely and safely mount a tool, such as a miter saw.

While these and other prior art approaches have been found operable, there remains a need for improvements in the manner in which tools, supplies and/or workpieces may be securely and precisely supported by a work bench or other substrate structure. It is to these and other improvements that various embodiments of the present invention are generally directed.

SUMMARY

Various embodiments of the present invention are generally directed to a support and attachment assembly for a substrate structure, such as a work bench.

In accordance with some embodiments, the support and attachment assembly generally comprises a rigid body comprising a front surface, a back surface, and a bottom surface. A hinge flange extends from the front surface, a boss member extends from the bottom surface, and a latching member is coupled to the body.

The support and attachment assembly is attached to the substrate structure by insertion of the hinge flange into a hinge aperture in the substrate structure. The body is rotated while the hinge flange remains in said hinge aperture to insert the boss member into a boss aperture through the substrate structure and to bring the bottom surface into facing relation with a top surface of the substrate structure. The latching member then contactingly engages the substrate structure to lockingly secure the assembly to the substrate structure.

These and other features and advantages which characterize the various embodiments of the present invention can be understood in view of the following detailed discussion and the accompanying drawings.

DETAILED DESCRIPTION

Figure 1:
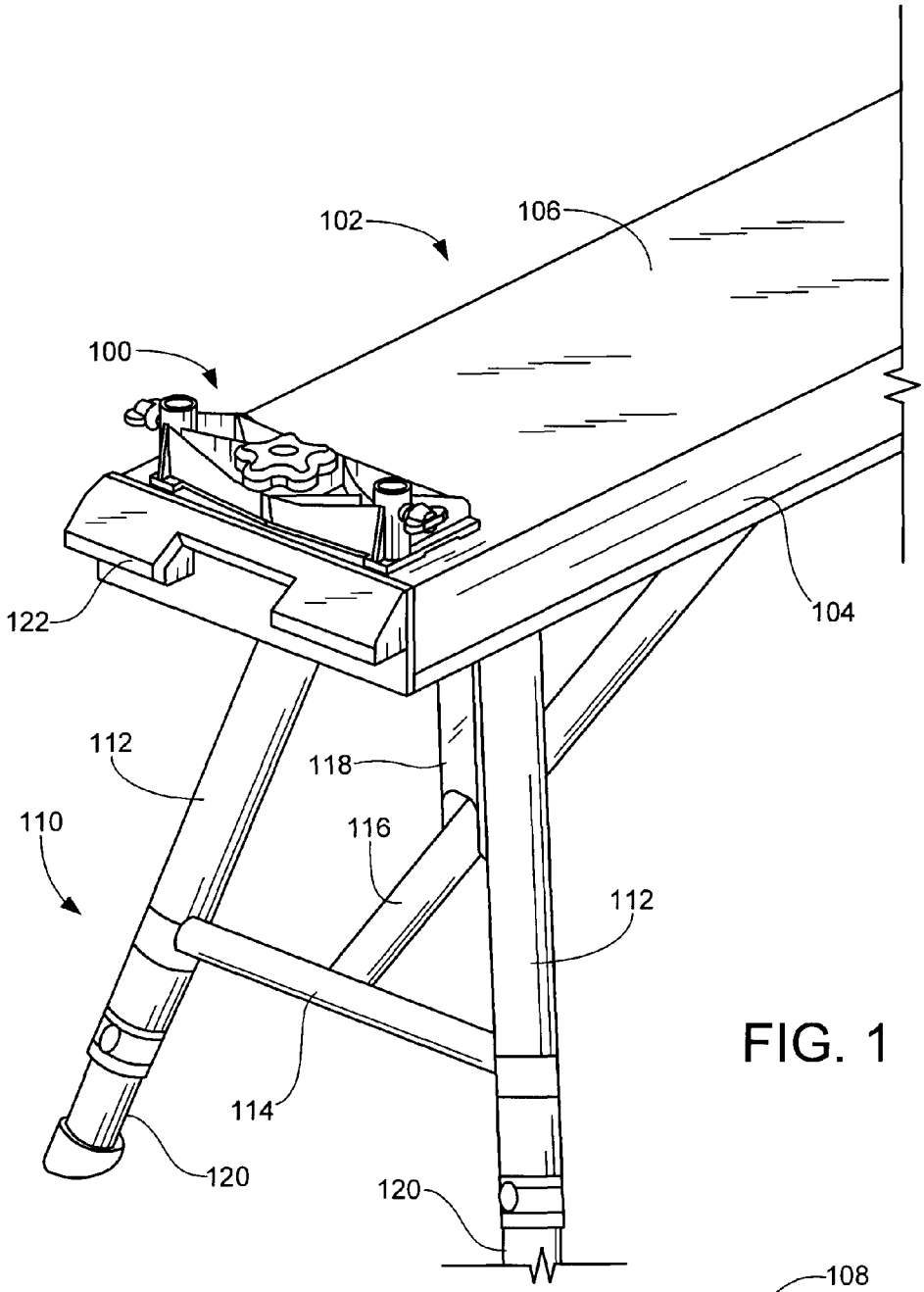
FIG. 1 shows an isometric representation of a portion of a work bench in conjunction with a bench support and attachment assembly constructed and operated in accordance with various embodiments of the present invention.

FIG. 1 is an isometric view of a bench support and attachment assembly 100 ("attachment assembly") constructed and operated in accordance with various embodiments of the present invention.

The attachment assembly 100 is mounted to a first end of a work bench 102. Although not shown in FIG. 1, a second attachment assembly 100 can be attached to an opposing, second end of the work bench 102. The attachment assembly 100 and the work bench 102 can each take any number of forms, so that the embodiment of FIG. 1 is merely illustrative and not limiting. For example, the attachment assembly 100 can be adapted for use with other types of substrate structures other than the work bench 102 such as a ladder, a support plate, a floor or wall structure, etc.

Figure 1A:
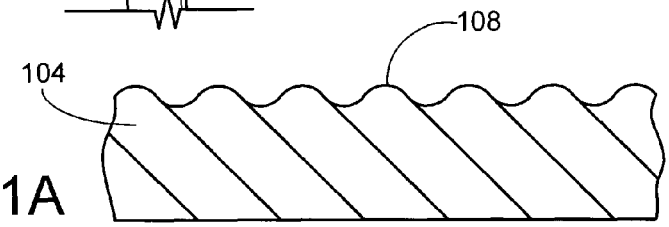
FIG. 1A illustrates longitudinally extending corrugation channels that may be formed in a top surface of the work bench of FIG. 1.

One suitable construction for the work bench 102 in FIG. 1 is generally disclosed in the aforementioned Emmert U.S. Pat. No. 4,191,111 reference. The work bench 102 includes a bench top 104 that provides a work bench surface 106. The bench top 104 is formed of a suitable material, such as extruded aluminum, and comprises an inverted, u-shaped channel structure of substantially uniform thickness. Longitudinally extending corrugations, or channels 108 can be formed in the bench top 104 as generally represented in FIG. 1A. The channels increase skid resistance of the work bench surface 106, which can be desirable when the bench is used as a scaffold on which a user stands.

The bench top 104 is supported by a pair of folding leg and brace structures 110, only one of which is shown in FIG. 1. Each folding leg and brace structure 110 includes a pair of spaced apart outer leg assemblies 112 which are supported by a cross-bar 114, a brace 116 and a strut 118. Telescopic legs 120 extend from the outer leg assemblies 112 to allow the user to set the elevation of the work bench surface 106 to a desired height above a floor surface.

An end cap 122 is attached to each end of the bench top 104 to provide handle surfaces while the bench is manipulated by a user. The bench can be placed in an extended (deployed) condition as shown in FIG. 1, or in a retracted condition in which the leg and brace structures 110 are folded up into the underlying channel of the bench top 104.

Figure 2:
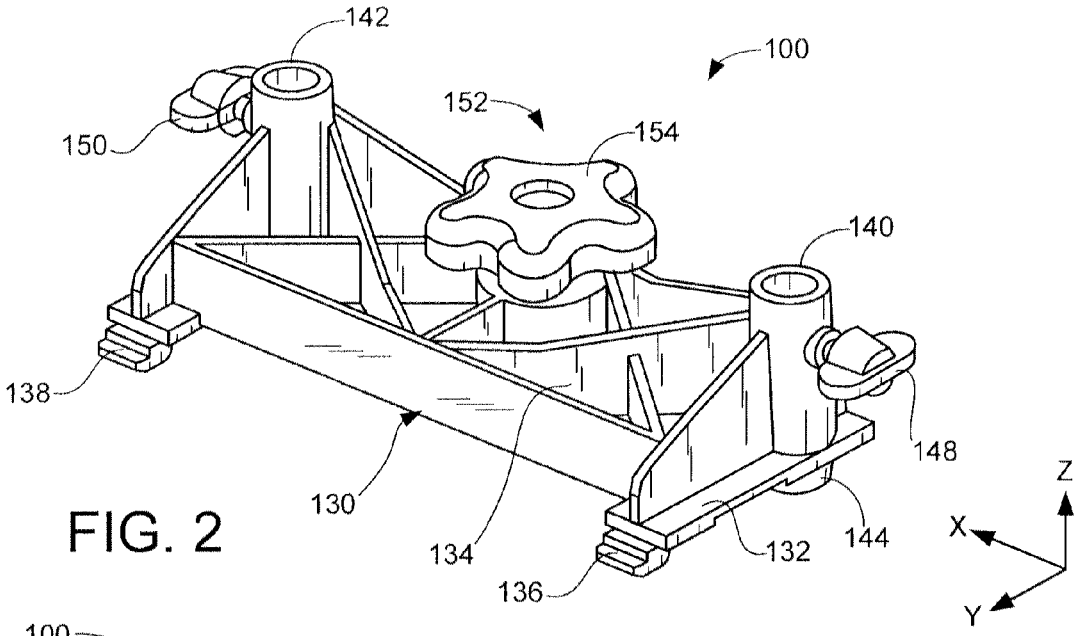
FIG. 2 is an isometric representation of the attachment assembly of FIG. 1 in greater detail.
Figure 3:
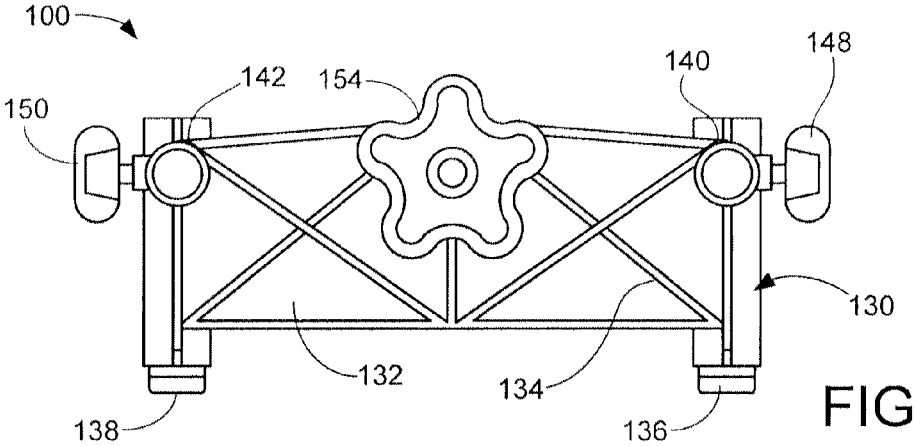
FIG. 3 provides a top plan view of the attachment assembly.
Figure 4:
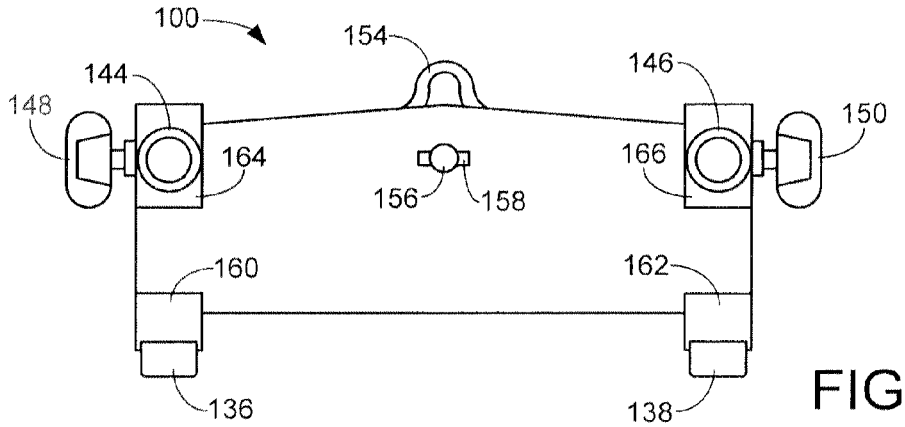
FIG. 4 provides a bottom plan view of the attachment assembly.

FIG. 2 provides an isometric view to illustrate various features of the attachment assembly 100. FIG. 3 is a top plan view of the attachment assembly 100, and FIG. 4 provides a bottom plan view. The attachment assembly 100 includes a body 130 formed of a suitable rigid material, such as injection molded plastic. The body 130 includes a substantially horizontal base member 132. An array of substantially vertical, intersecting web members 134 extend upwardly from the base member 132. The base and web members 132, 134 cooperate to provide a lightweight, solid framework for the attachment assembly 100.

A pair of forward facing insertion and locking flanges 136, 138 project from a front portion of the body 130. As explained below, the flanges 136, 138 operate as hinge members to orient and guide the attachment assembly 100 during mounting of the assembly to the bench 102. A pair of support channel members 140, 142 are respectively aligned with the flanges 136, 138 along a rearward portion of the body 130 in respective corners thereof.

The support channel members 140, 142 are generally characterized as hollow cylindrical tubes. A tapered location boss 144 is disposed at a lower extent of the channel member 140, and a tapered location boss 146 is disposed at a lower extent of the channel member 142. Set screw assemblies 148 and 150 extend through the sidewalls of the channel members 140, 142 to secure a variety of tool support members therein.

A spring-biased retainer and tensioner assembly 152 ("tensioner") is located in a medial portion of the body 130 along the rearward portion thereof. A suitable construction for the tensioner is disclosed in U.S. Pat. No. 6,283,462 to Emmert, assigned to the assignee of the present application. The tensioner 152 includes a user activated knob 154 coupled to a central shaft 156. A locking tab 158, characterized as a transverse bar, extends through a distal end of the central shaft. A coiled spring 159 extends around the central shaft to provide an upwardly directed biased force upon the knob 154.

Raised contact pads 160, 162, 164 and 166 are shown in FIG. 4. The contact pads extend a common distance above a base surface 168 of the base member 132 and are located adjacent to the respective flanges 136, 138 and boss members 144, 146. The pads 160, 162, 164 and 166 ensure a flat engagement of the body 130 with the bench 102. This eliminates the need to maintain the entire extent of the base surface 168 within tight flatness tolerances, which can be difficult to achieve with injection molded articles.

Figure 5:
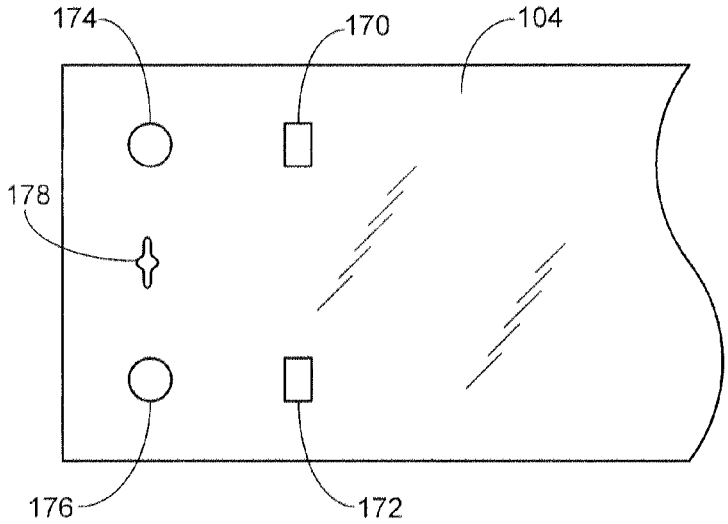
FIG. 5 shows various mounting apertures of the bench of FIG. 1 suitable for use in mounting the attachment assembly to the work bench.

FIG. 5 shows a portion of the bench 102 to illustrate various apertures that extend through the bench top 104 to facilitate mating engagement of the attachment assembly 100. These apertures include rectangular flange apertures 170, 172 for the flanges 136 and 138, annular boss apertures 174, 176 for the boss members 144 and 146, and an elongated aperture 178 for the tensioner 152.

Figure 6:
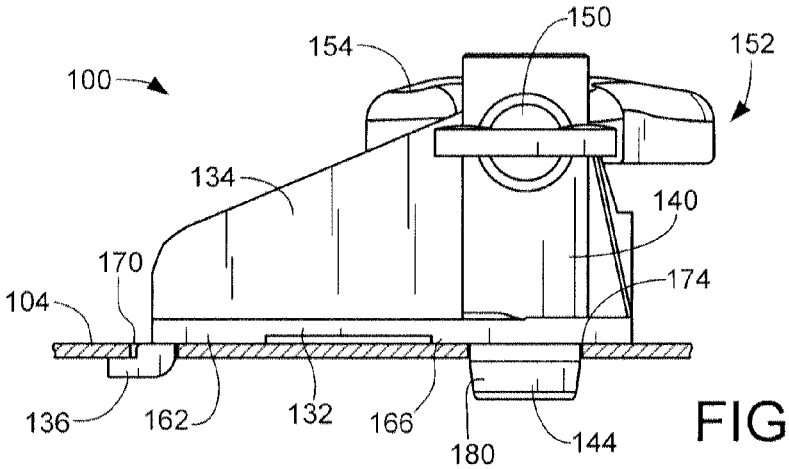
FIG. 6 provides an elevational, partial cross-sectional view of the attachment assembly mounted to the bench using the mounting apertures of FIG. 5.
Figure 7:
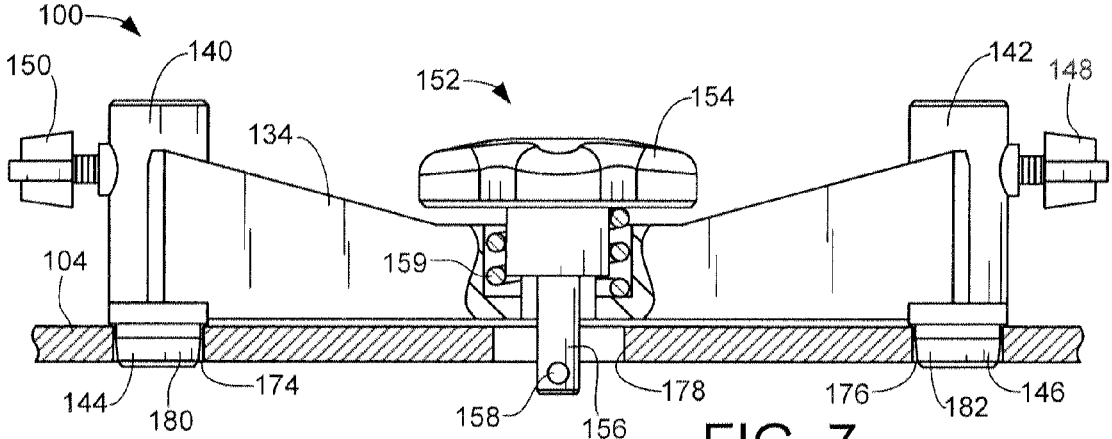
FIG. 7 is a back elevational view of the attachment assembly mounted to the bench.

FIG. 6 shows a side elevational view of the attachment assembly 100 engaged with the bench top 104. In FIG. 6, the flange 136 is disposed within the aperture 170, and the boss member 144 is disposed within the aperture 174. FIG. 7 shows a rear elevational view of the attachment assembly 100 engaged with the bench top 104. In FIG. 7, the boss members 144, 146 are respectively disposed within the apertures 174, 176, and the tensioner 152 extends through the elongated aperture 178.

From FIGS. 6-7 it can be seen that the boss apertures 174, 176 are closely sized with respect to the outermost diameters of the boss members 144, 146. The boss members 144, 146 serve as location features for the attachment assembly 100 and achieve a precise x-y alignment of the assembly onto the bench top 104. In some embodiments, outer surfaces 180, 182 of the boss members 144, 146 are tapered to provide a frustoconical shape to each boss member, thereby facilitating ease of insertion of the boss members into the respective apertures.

Figure 8A:
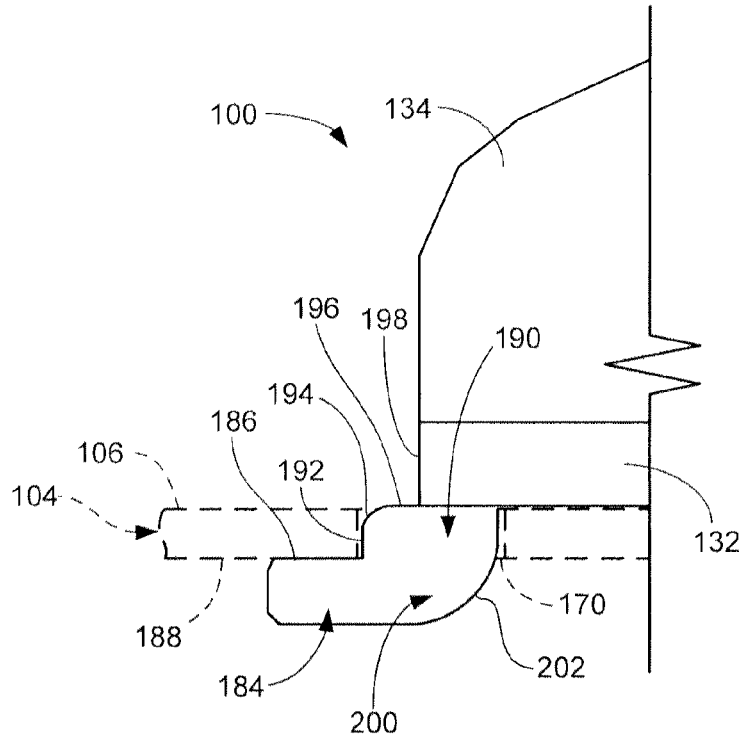
FIGS. 8A-8C generally illustrate an attachment sequence for the attachment assembly in accordance with some embodiments.

FIG. 8A shows a portion of the attachment assembly 100 as arranged in FIG. 6 to illustrate a preferred orientation of the flange 136 within the flange aperture 170. While the second flange 138 is not separately shown, it will be appreciated that the flange 138 has corresponding features and mates with the flange aperture 172 in similar fashion.

The flange 136 takes a stepped configuration with a forward extending toe portion 184. An upper planar surface 186 of the toe portion 184 contactingly abuts a lower facing surface 188 of the bench member 104. A riser portion 190 of the flange 136 couples the toe portion 184 to the base 132, and includes a forward facing, vertically extending surface 192, a curvilinearly extending clearance surface 194, and a horizontally extending surface 196. The horizontal surface 196 adjoins a forward facing, vertically extending surface 198 of the attachment housing base 132. A heel portion 200 of the flange 136 includes a rearward facing, curvilinearly extending clearance surface 202.

Figure 8B:
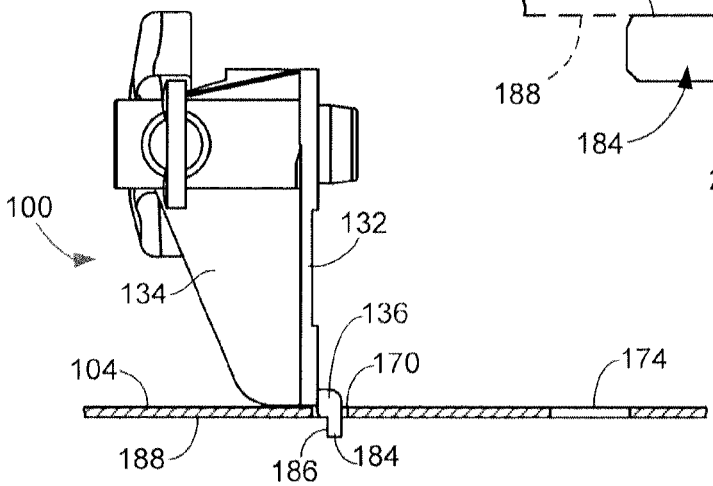
Figure 8C:
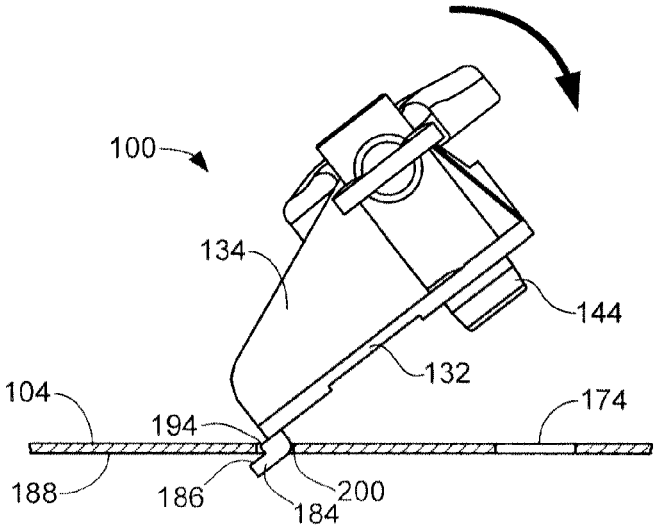

These respective features facilitate rotational engagement of the attachment assembly 100 with the bench top 104 as illustrated in FIGS. 8B and 8C. In FIG. 8B, the user initially positions the attachment assembly 100 onto the bench top 104 by rotating the assembly forward 90 degrees, and inserting the flanges 136, 138 into the respective flange apertures 170, 172 (FIG. 5). In this position, the normally vertically extending surface 198 of the attachment assembly body (see FIG. 8A) contactingly rests upon the top surface 106 of the bench top 104. The toe portion 184 extends downwardly through the aperture 170, and the planar surface 186 is substantially normal to the bench top facing surface 188.

While maintaining the flanges 136 and 138 in the respective flange apertures 170 and 172, the user rotates the rear portion of the attachment assembly 100 toward the bench top 104, as represented in FIG. 8C. As the assembly 100 is rotated, the curvilinearly extending clearance surfaces 194, 200 (FIG. 8A) allow the flanges 136, 138 to freely rotate within the flange apertures 170, 172.

As this rotation continues, the boss members 144, 146 will insertingly pass into the corresponding boss apertures 174, 176 (FIG. 7). The tapered outer surfaces 180, 182 of the boss members facilitate sliding engagement of the boss members into the boss apertures. Further rotation will be inhibited once the four pads 160, 162, 164, 166 (see FIG. 4) contactingly engage the top surface 106 of the bench top 104, and the planar surfaces 186 of the flanges 136, 138 come into contacting engagement with the underlying surface 188 of the bench top 104.

At this point, the user depresses the tensioner knob 154 downwardly to pass the shaft 156 and cross-bar member 158 through the elongated aperture 178, and rotates the knob 154 to lock the tensioner 152 in place. In this way, the attachment member 100 is lockingly secured to the bench 102, as depicted in FIGS. 6 and 7.

More specifically, the close fit of the boss members 144, 146 within the apertures 174, 176 serves to locate and rigidly hold the body of the attachment assembly 100 from movement along the longitudinal and lateral (x and y) directions. The bias force of the spring 159 holds the cross-bar 158 securely against the bottom surface 188 of the bench top 104, locking the body of the attachment assembly from movement along the vertical (z) direction. The flanges 136, 138 further contribute to the rigid holding of the attachment assembly body in all three axes (x, y and z); the upper surfaces 186 of the flanges 136, 138 are contactingly biased against the bottom surface 188 of the bench top 104 to limit vertical movement, and the sides of the flanges 136, 138 closely abut the sides of the apertures 170, 172 to limit longitudinal and lateral movement.

Figure 9:
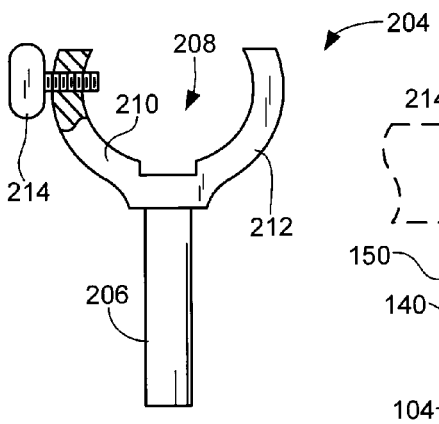
FIG. 9 is a cross-sectional view of a y-shaped support member adapted for use with the attachment assembly.

Once the attachment assembly 100 is securely locked to the work bench 102, one or more tool supports can be installed onto the attachment assembly to secure a variety of tools and workpieces relative to the bench. One such tool support is shown in FIG. 9, which illustrates a generally y-shaped clamp member 204. The clamp member 204 has a cylindrical shaft 206 with an outer diameter sized to nest within either of the support channels 140, 142. Extending from the cylindrical shaft 206 is a curvilinearly extending cup assembly 208 with opposing arms 210, 212. A set screw 214 extends through the arm 210.

The shaft 206 is configured to be fully inserted into a selected one of the channel members 140, 142 of the attachment assembly 100 so that an underside of the cup assembly 208 comes into contacting engagement with a top surface of the selected channel member, after which the shaft 206 is rigidly affixed to the attachment assembly using the associated set screw (150 or 152). A workpiece is inserted into the cup assembly 208 and secured therein using the set screw 214.

Figure 10A:
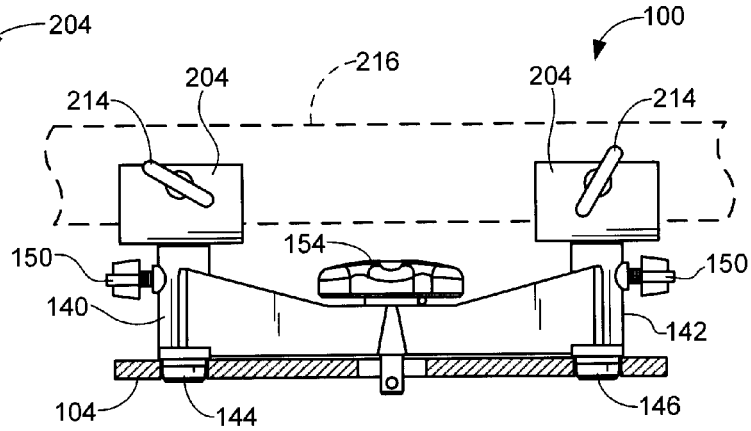
FIG. 10 shows a pair of the support members of FIG. 9 supporting an exemplary workpiece.

FIG. 10A shows a first exemplary workpiece 216 secured by a pair of the clamp members 204 of FIG. 9 installed in the respective channel members 140, 142. The workpiece is characterized as an elongated cylindrical pipe. The clamp members 204 are arranged so that the pipe 216 is transversely mounted across the body 130 of the attachment assembly 100 along the y-direction, and the set screws 214 are tightened to secure the pipe 216 in this configuration.

The pipe 216 can be used in a number of ways, such as a support for a spool of wire (not shown), a support for scaffolding or other weight bearing structure, a fence/support to support a distal end of a piece of lumber, etc. The attachment assembly 100 and clamp members 204 can alternatively serve as a vise, allowing a suitable work operation to be performed on the pipe, such as a cutting or drilling operation.

Figure 10B:
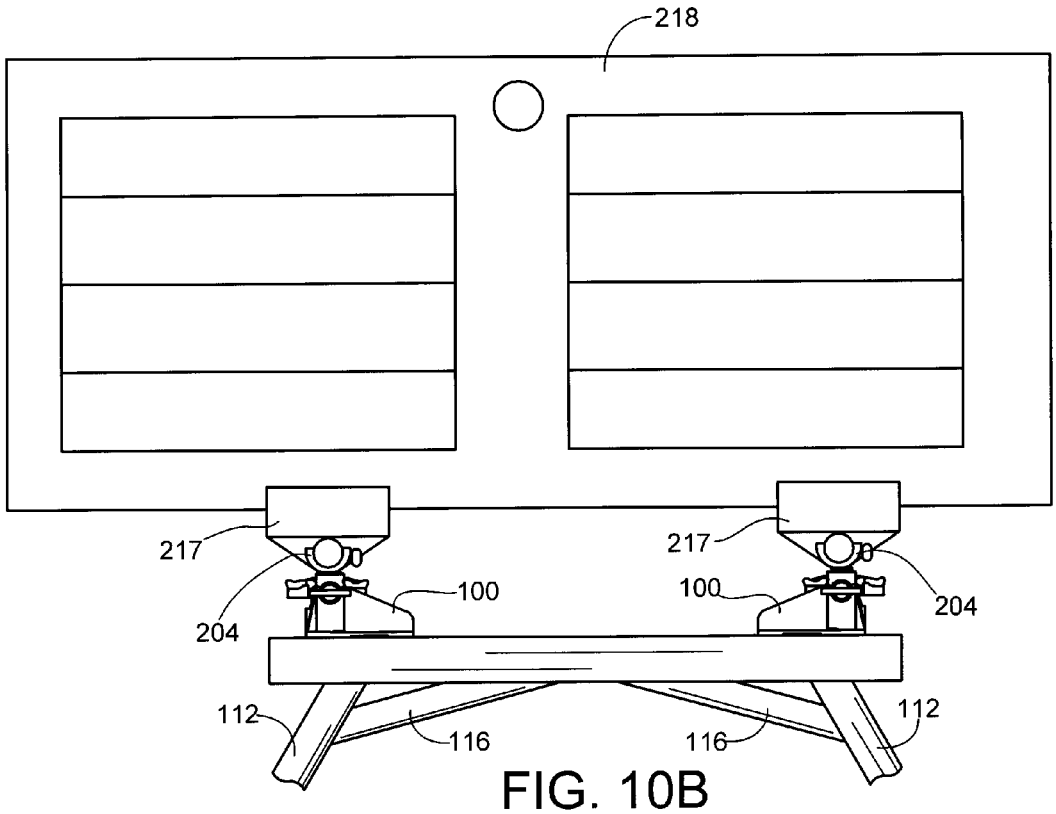

The clamp assemblies 204 can be rotated to any desired angular orientation relative to the attachment assembly 100. FIG. 10B shows an alternative configuration in which two attachment assemblies 100 are attached to the bench top 104, one at each end. A clamp member 204 can be used in each of the attachment assemblies to support a pipe clamp assembly 217 or similar support mechanism to grasp and secure an elongated workpiece 218 along the length of the bench top 104. The workpiece 218 is characterized as a door in FIG. 10B, although other workpieces can be supported in this configuration, including but not limited to a pipe as in FIG. 10A.

Figure 11:
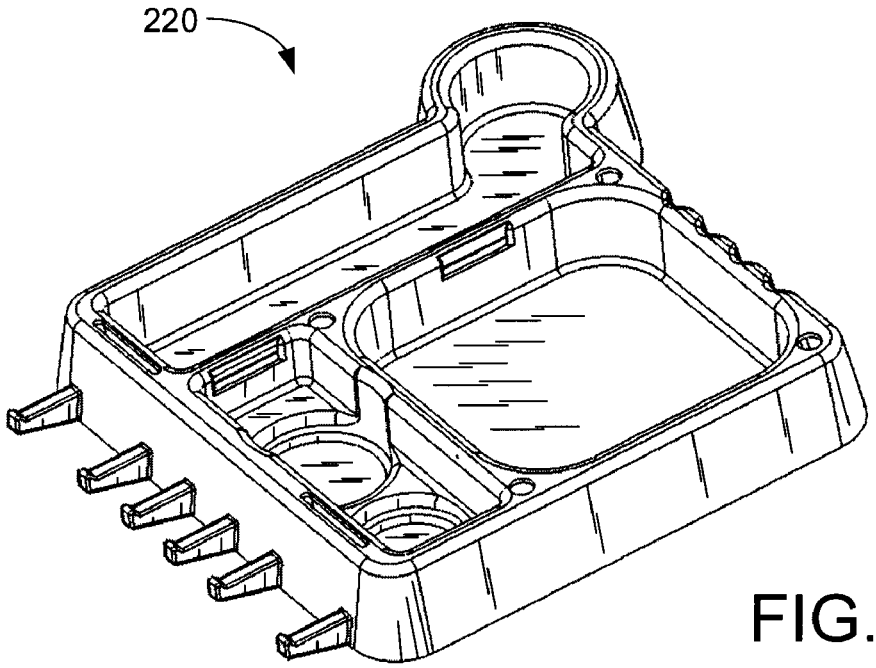
FIG. 11 is an isometric representation of a tool tray.
Figure 12:
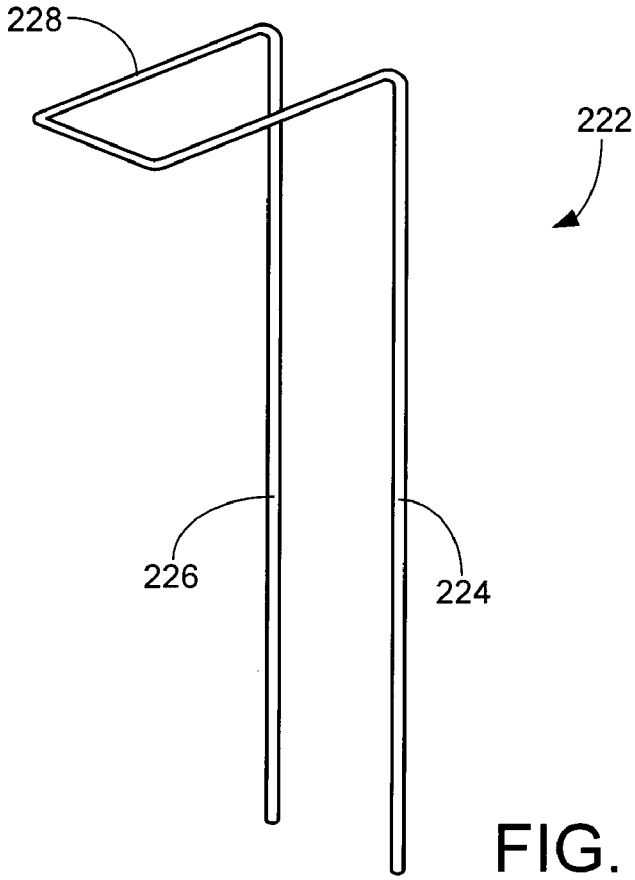
FIG. 12 is an elongated wire frame support member adapted to support the tool tray of FIG. 11.
Figure 13:
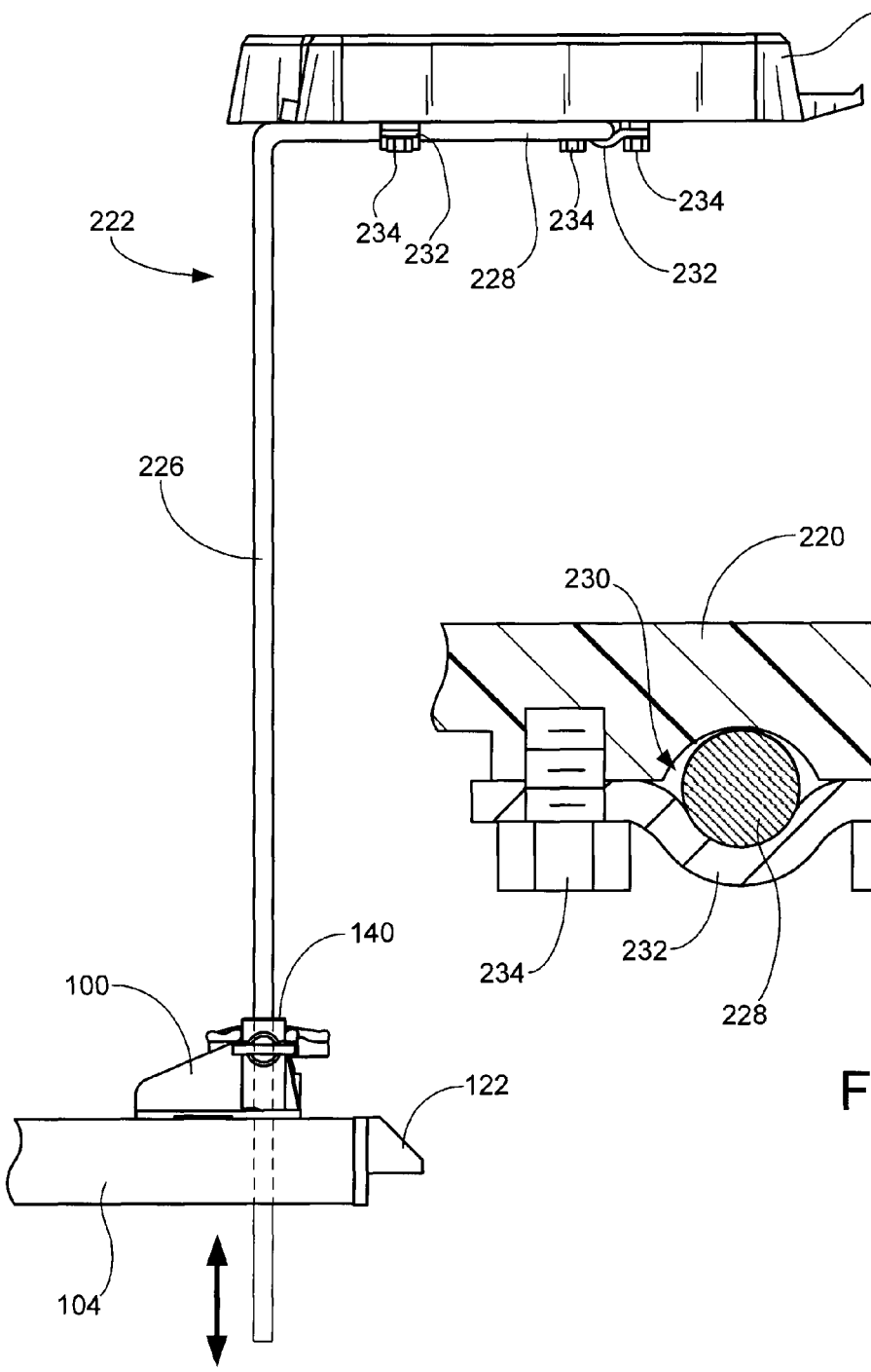
FIG. 13 shows the tool tray and wire frame support member supported by the attachment assembly at a selected elevation above the work bench.

FIG. 11 shows another exemplary workpiece 220 characterized as a tool tray suitable for use in supporting various tools and supplies, such as in the environment of paintless automotive dent repair. The tool tray is formed of a suitable rigid material, such as injection molded plastic, and includes a number of features such as hooks, paint tray slots and cup recesses to facilitate various operations. A wire frame support member 222 is shown in FIG. 12, and is adapted to support the tool tray 220 at a desired elevation above the work bench 102, as shown in FIG. 13.

The wire frame support member 222 can be formed from a single piece of metal bar stock, and includes a pair of elongated legs 224, 226 which are inserted into the support channels 140, 142 of the attachment assembly 100. The elevational height of the tool tray 220 can be adjusted by sliding the legs 224, 226 up or down within the channels 140, 142 and tightening the set screws 150, 152. As desired, the legs 224, 226 can be made to extend through the bottoms of the channels 140, 142 so as to pass through, and below, the bench 102.

In this way, the relative height of the tool tray 220 can be set to various heights depending on the needs of a user; for example, one height may allow access to the tool tray while the user stands on the bench top 104, while a different height may allow the user to access the tool tray while standing on the floor next to the bench 102. It will be appreciated that other types of tool trays and support structures can be generally supported in this manner, including but not limited to seats, scaffolding supports, ladder rungs, etc.

Figure 14:
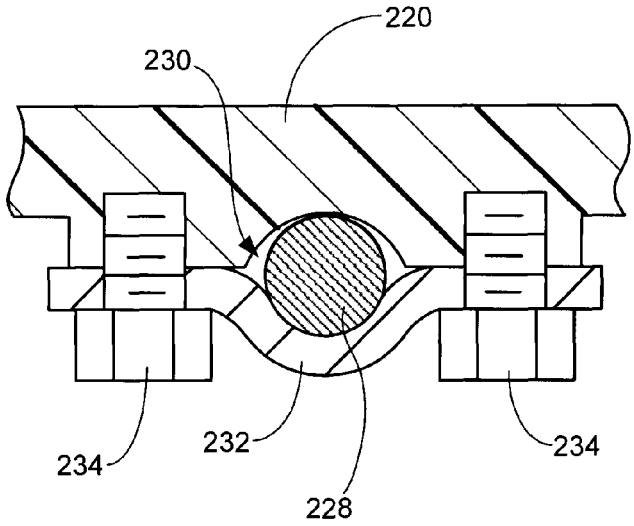
FIG. 14 is a cross-sectional representation of an exemplary manner in which the write frame support member can be affixed to the tool tray.

A horizontal loop support 228 of the wire frame support member 222 can be affixed to the underside of the tool tray 220 using a variety of attachment configurations. One exemplary configuration is shown in FIG. 14, which provides a channel 230 in the underside of the tool tray 200 along which the loop support 228 is routed. An attachment plate 232 is placed over the loop support 228 and affixed to the body of the tool tray 220 via threaded fasteners 234.

It will now be appreciated that the various embodiments set forth herein provide a number of advantages over the prior art. A support and attachment assembly such as 100 can be readily adapted for secure attachment to any number of different types and styles of substrates, including but not limited to the various work benches disclosed herein. The use of a hinge flange such as 136, 138 to rotationally engage a top surface of the substrate enables the attachment assembly to be securely located and affixed to the top surface within tightly controlled x, y and z tolerances.

The use of a tensioner such as 152 allows for quick attachment and release of the body of the attachment assembly to the substrate. The use of channels such as 140, 142 that extend through corresponding apertures in the substrate surface (such as 174, 176) allows tool supports to extend all the way through the attachment assembly and the underlying substrate, providing a wide range of adjustability depending on the needs of the user.

While the various embodiments disclosed herein have been generally directed to an attachment assembly with two hinge flanges (e.g., 136, 138), two bosses (e.g., 144, 146) and a centrally disposed quick disconnect tensioner assembly (e.g., 152), it will be appreciated that such is merely for purposes of illustration and is not necessarily limiting. Fewer or greater numbers of these features, and non-symmetric placement of such features, can also be readily incorporated in view of the foregoing discussion.

Moreover, while the exemplary attachment assembly includes channel and boss members with cylindrical inner and outer surfaces, it will be appreciated that any number of other annular configurations can be used including semicircular, segmented, square, rectilinear, etc.

Without limitation, it will now be appreciated that various embodiments of the present invention can be generally characterized as a support and attachment assembly (such as 100 in FIG. 1) configured for attachment to a substrate structure (such as 102 in FIG. 1), comprising a rigid body (such as 130 in FIG. 2) comprising a front surface (such as 198 in FIG. 8A), a back surface (such as 134 in FIG. 7) opposite the front surface, and a bottom surface (such as 168 in FIG. 4) extending between the front and back surfaces; a hinge flange (such as 136, 138 in FIG. 2) which extends from the front surface; a boss member (such as 144, 146 in FIG. 4) which extends from the bottom surface; and a latching member (such as 152 in FIG. 7) coupled to the body.

The support and attachment assembly is generally configured for attachment to the substrate structure by insertion (such as in FIG. 8B) of the hinge flange into a hinge aperture (such as 170, 172 in FIG. 5) through the substrate structure, rotation (such as in FIG. 8C) of the body while the hinge flange remains in said hinge aperture to insert the boss member into a boss aperture (such as 174, 176 of FIG. 5) through the substrate structure, and contacting engagement of the latching member with the substrate structure (such as in FIG. 7) to bring the bottom surface into facing relation with a top surface (such as 106 in FIG. 1) of the substrate structure.

For purposes of the appended claims, reference to orientation characteristics such as top, bottom, vertical, horizontal, underlying and the like will be understood to be interrelational with respect to other recited orientation characteristics, and not defined or limited with respect an external reference such as the plane of an underlying horizontal floor surface. For example, the exemplary attachment assembly could readily be attached to a vertical wall surface, or attached in an orientation that is upside down or skewed with respect to the orientations presented in the various views in the figures. The recited orientation characteristics in the claims will cover these and other such orientations.

Further, the recited "first means for supporting" will be understood consistent with the foregoing discussion to correspond to the various disclosed support members including the y-shaped clamp member 204, the tool tray 220, and the wire frame support member 222.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. A support and attachment assembly configured for attachment to a substrate structure, comprising:

a rigid body comprising a front surface, a back surface opposite the front surface, and a bottom surface extending between the front and back surfaces;

a hinge flange which extends from the front surface;

a boss member which extends from the bottom surface, the boss member forming a distal end of a support channel member which extends through the body, said channel member characterized as a tubular conduit with an annular interior surface;

a latching member coupled to the body, wherein the support and attachment assembly is structurally configured for attachment to the substrate structure by insertion of the hinge flange into a hinge aperture in the substrate structure, rotation of the body while the hinge flange remains in said hinge aperture to insert the boss member into a boss aperture through the substrate structure and to bring the bottom surface into facing relation with a top surface of the substrate structure, and contacting engagement of the latching member with the substrate structure to lockingly secure the support and attachment assembly to said substrate structure; and a securing mechanism coupled to the channel member to contactingly engage a shaft of a tool support extending along said tubular conduit adjacent the annular interior surface, the securing mechanism comprising a threaded set screw that extends through said annular interior surface.

2. The support and attachment assembly of claim 1, wherein the boss member has an outer surface with a frustoconical shape to facilitate insertion thereof into the boss aperture.

3. The support and attachment assembly of claim 1, wherein the hinge flange has a stepped configuration comprising:

a forward extending toe portion with an upper planar surface configured to contactingly abut a lower facing surface of the substrate when the latching member engages the substrate structure;

a riser portion coupled to the toe portion comprising a forward facing, vertically extending surface, a curvilinearly extending first clearance surface, and a horizontally extending surface which adjoins said front surface of the body; and a heel portion coupled to the riser portion comprising a rearward facing, curvilinearly extending second clearance surface, wherein the first and second clearance surfaces facilitate clearing rotation of the hinge flange within the hinge aperture to bring the upper planar surface into contacting engagement with the lower facing surface of the substrate.

4. The support and attachment assembly of claim 1, wherein the hinge flange is characterized as a first hinge flange and the hinge aperture is characterized as a first hinge aperture, wherein the support and attachment assembly further comprises a second hinge flange spaced apart from the first hinge flange and extending from the front surface, and wherein the second hinge flange is configured for insertion into and rotation within a second hinge aperture concurrent with said insertion into and rotation of the first hinge flange within the first hinge flange aperture.

5. The support and attachment assembly of claim 4, wherein the boss member is characterized as a first boss member and the boss aperture is characterized as a first boss aperture, wherein the support and attachment assembly further comprises a second boss member spaced apart from the first boss member and extending from the bottom surface, and wherein the second boss member is configured for concurrent insertion into the second boss aperture during insertion of the first boss member into the first boss aperture.

6. The support and attachment assembly of claim 1, wherein the latching member comprises a spring biased tensioner comprising a central shaft, a user operated knob coupled to a proximal end of the central shaft, a biasing member which provides a biasing force upon said shaft, and a laterally extending member coupled to a distal end of the shaft, wherein the latching member is structurally configured to facilitate depression of the knob by a user to pass the distal end of the shaft and the laterally extending member through an elongated aperture in the support structure, and to facilitate rotation of the depressed knob by said user to rotate the laterally extending member into contacting engagement with a lower facing surface of the support structure opposite said top surface of the support structure.

7. The support and attachment assembly of claim 1, further comprising first means for engaging the support and attachment assembly to support an article relative to the substrate surface.

8. The support and attachment assembly of claim 1, wherein the substrate structure comprises a portable work bench.

9. A support and attachment assembly configured for attachment to a substrate structure, comprising:

a body formed of a rigid material;

a stepped hinge flange which extends from a front surface of the body;

a latching member which extends through a bottom surface of the body;

a boss member which extends from the bottom surface of the body adjacent a back surface of the body opposite the front; and a latching member coupled to the body, wherein the support and attachment assembly is structurally configured for attachment to the substrate structure with the bottom surface in facing relation with a top surface of the substrate structure by insertion of the hinge flange into a hinge aperture in the substrate structure, rotation of the body while the hinge flange remains in said hinge aperture to insert the boss member into a boss aperture through the substrate structure, and contacting engagement of the latching member with the substrate structure;

wherein the hinge flange comprises:

a forward extending toe portion with an upper planar surface configured to contactingly abut a lower facing surface of the substrate when the latching member engages the substrate structure;

a riser portion coupled to the toe portion comprising a forward facing, vertically extending surface, a curvilinearly extending first clearance surface, and a horizontally extending surface which adjoins said front surface of the body; and a heel portion coupled to the riser portion comprising a rearward facing, curvilinearly extending second clearance surface, wherein the first and second clearance surfaces facilitate clearing rotation of the hinge flange within the hinge aperture to bring the upper planar surface into contacting engagement with the facing surface of the substrate.

10. The support and attachment assembly of claim 9, wherein the boss member has an outer surface with a frustoconical shape to facilitate insertion thereof into the boss aperture.

11. The support and attachment assembly of claim 9, wherein the boss member forms a distal end of a support channel member which extends through the body, said channel member characterized as a tubular conduit with an annular interior surface.

12. The support and attachment assembly of claim 11, further comprising a securing mechanism coupled to the support channel member to contactingly engage a shaft of a tool support ending along said tubular conduit adjacent the annular interior surface.

13. The support and attachment assembly of claim 12, wherein the securing mechanism comprises a threaded set screw that extends through said annular interior surface.

14. The support and attachment assembly of claim 9, wherein the hinge flange is characterized as a first hinge flange and the hinge aperture is characterized as a first hinge aperture, wherein the support and attachment assembly further comprises a second hinge flange spaced apart from the first hinge flange and extending from the front surface, and wherein the second hinge flange is configured for insertion into and rotation within a second hinge aperture concurrent with said insertion into and rotation of the first hinge flange within the first hinge flange aperture.

15. The support and attachment assembly of claim 14, wherein the boss member is characterized as a first boss member and the boss aperture is characterized as a first boss aperture, wherein the support and attachment assembly further comprises a second boss member spaced apart from the first boss member and extending from the bottom surface, and wherein the second boss member is configured for concurrent insertion into the second boss aperture during insertion of the first boss member into the first boss aperture.

16. A support and attachment assembly configured for attachment to a substrate structure, comprising:

a body formed of a rigid material;

a stepped hinge flange which extends from a front surface of the body;

a latching member which extends through a bottom surface of the body;

a boss member which extends from the bottom surface of the body adjacent a back surface of the body opposite the front surface; and a latching member coupled to the body, wherein the support and attachment assembly is structurally configured for attachment to the substrate structure with the bottom surface in facing relation with a top surface of the substrate structure by insertion of the hinge flange into a hinge aperture in the substrate structure, rotation of the both while the hinge flange remains in said hinge aperture to insert the boss member into a boss aperture through the substrate structure, and contacting engagement of the latching member with the substrate structure, wherein the latching member comprises a spring biased tensioner comprising a central shaft, a user operated knob coupled to a proximal end of the central shaft, a biasing member which provides a biasing force upon said shaft, and a laterally extending member coupled to a distal end of the shaft, wherein the latching member is structurally configured to facilitate depression of the knob by a user to pass the distal end of the shaft and the laterally extending member through an elongated aperture in the support structure, and to facilitate rotation of the depressed knob by said user to rotate the laterally extending member into contacting engagement with a lower facing surface of the support structure opposite said top surface of the support structure.

17. The support and attachment assembly of claim 16, wherein the substrate structure comprises a portable work bench.

* * * * *

UNITED STATES PATENT AND TRADEMARK OFFICE

CERTIFICATE OF CORRECTION

PATENT NO. : 8,297,573 B1
APPLICATION NO. : 12/537000
DATED : October 30, 2012
INVENTOR(S) : Raymond L. Emmert It is certified that error appears in the above-identified patent and that said Letters Patent is hereby corrected as shown below:

In Col. 10, line 36
replace "rotation of the both"
with "rotation of the body"

Signed and Sealed this
Twenty-fifth Day of December, 2012

David J. Kappos

David J. Kappos
*Director of the United States Patent and Trademark Office*